US011154118B2

(12) United States Patent
Conti et al.

(10) Patent No.: US 11,154,118 B2
(45) Date of Patent: Oct. 26, 2021

(54) FOOTWEAR ACCESSORY

(71) Applicants: Jamison Barron Conti, Goleta, CA (US); Sam Nelson Smith, Goleta, CA (US)

(72) Inventors: Jamison Barron Conti, Goleta, CA (US); Sam Nelson Smith, Goleta, CA (US)

( * ) Notice: Subject to any disclaimer, the term of this patent is extended or adjusted under 35 U.S.C. 154(b) by 0 days.

(21) Appl. No.: 16/826,186

(22) Filed: Mar. 21, 2020

(65) Prior Publication Data

US 2020/0214397 A1 Jul. 9, 2020

Related U.S. Application Data

(60) Provisional application No. 62/974,505, filed on Dec. 5, 2019.

(51) Int. Cl.
*A43B 23/26* (2006.01)
*A43B 7/18* (2006.01)
*A43B 7/32* (2006.01)

(52) U.S. Cl.
CPC ..... *A43B 23/26* (2013.01); *A43B 7/18* (2013.01); *A43B 7/32* (2013.01)

(58) Field of Classification Search
CPC ..... A43B 7/1465; A43B 7/1495; A43B 7/18; A43B 7/32; A43B 23/26; A43B 19/00; A61F 13/065
USPC ..... 36/133, 54
See application file for complete search history.

(56) References Cited

U.S. PATENT DOCUMENTS 1,518,217 A * 12/1924 Palm ..... A61F 13/065 602/66
1,668,459 A * 5/1928 Levitt ..... A61F 13/065 602/66
1,709,635 A * 4/1929 Skoglund ..... A61F 5/14 602/66
3,086,520 A * 4/1963 Scholl ..... A43B 7/22 602/29
4,510,699 A * 4/1985 Nakamura ..... A61F 5/14 36/173
4,753,228 A * 6/1988 Seiner ..... A61F 13/066 36/89
5,898,939 A * 5/1999 Schramm ..... A41D 13/0568 2/22
2002/0139009 A1* 10/2002 Mark ..... A43B 7/18 36/54
2007/0084080 A1* 4/2007 Heiderer ..... A41B 11/001 36/2 R
2018/0132561 A1* 5/2018 Covel ..... A43B 5/025
2019/0105187 A1* 4/2019 Brown ..... A61F 5/05858

* cited by examiner

*Primary Examiner* — Ted Kavanaugh
(74) *Attorney, Agent, or Firm* — Barry Choobin; Patent 360

(57) ABSTRACT

The present invention is directed to a footwear accessory comprising a pad and sleeve that extends from sides of the pad. The pad having a proximal end and a distal end, wherein the pad is wider at the proximal end in comparison to the distal end. The left and right sides of the pad tapers slightly inwards from the proximal end towards the distal end. The sleeve of the pad is configured to be snugly worn in the foot, such that when the foot accessory is worn, the pad is positioned over the bridge of the foot.

4 Claims, 5 Drawing Sheets

FOOTWEAR ACCESSORY

CROSS-REFERENCE TO RELATED APPLICATIONS

This application claims priority to the U.S. Provisional Patent Application Ser. No. 62/974,505 filed May 12, 2019, which is incorporated herein by reference in its entirety.

FIELD OF INVENTION

The present invention is related to a footwear accessory, and in more particular, to a footwear accessory for raising a tongue of the footwear.

BACKGROUND

Footwear, such as shoes are generally available in standard sizes and a customer can select the closest size which best fits his foot, however, the shoe may or may not fit perfectly. For example, if the shoe size is slightly bigger than the foot, the foot may slip forward in the shoe causing discomfort. Long term wearing of such shoes may also lead to injury of the foot. Besides the larger size, the shoe may also not fit properly on the upper side of the foot i.e. bridge of the foot. This can discomfort the wearer and the unfit shoe looks less appealing. For example, a tongue is provided on the top central area of the shoe above the bridge of the foot for protecting against lace biting. The lace bite refers to as rubbing of laces or any other fastening means to the foot. However, the tongue alone may not provide adequate protection against the lace bite and the continuous wearing of shoes for a longer period can become painful and may also cause injury to the foot. Moreover, the tongue itself may cause discomfort to the foot, while walking. Also, the depressed area over and around the tongue does not looks aesthetic. Furthermore, in case the tongue is thin, the laces and eyelets can cause discomfort to the foot.

Thus, a need is appreciated for a footwear accessory that can overcome the above problems associated with wearing shoes.

SUMMARY OF THE INVENTION

The following details present a simplified summary of the embodiments herein to provide a basic understanding of the several aspects of the embodiments herein. This summary is not an extensive overview of the embodiments herein. It is not intended to identify key/critical elements of the embodiments herein or to delineate the scope of the embodiments herein. Its sole purpose is to present the concepts of the embodiments herein in a simplified form as a prelude to the more detailed description that is presented later.

The principal objective of the present invention is therefore directed to a footwear accessory that provides added cushioning over bridge of the foot.

It is another objective of the present invention that the footwear accessory prevents slippage of the foot in a shoe.

It is still another objective of the present invention that the footwear accessory protects the foot against lace biting and eyelets.

It is a further objective of the present invention that the footwear accessory raises the tongue of the shoe, when worn.

It is still further objective of the present invention that the footwear accessory enhances both comfort and aesthetics of the shoe, when worn.

It is yet a further objective of the present invention that the footwear accessory is economic to manufacture and easy to use.

In one aspect, the present invention is directed to a footwear accessory comprising a pad and sleeve that extends from the sides of the pad. The pad having a proximal end and a distal end along length of the pad, wherein the pad is wider at the proximal end in comparison to the distal end. The left and right sides of the pad tapers slightly inwards from the proximal end towards the distal end. The top of the pad slopes downwards from the proximal end towards the distal end, such as the height of the pad at the proximal end is larger than the height of the pad at the distal end. The sleeve of the pad is configured to be snugly worn in the foot, such that when the foot accessory is worn in the foot, the pad is positioned over the bridge of the foot. In one exemplary embodiment, the pad is made of any cushioning material, such as foam. In another exemplary embodiment, the sleeve is made of any stretchable material.

In one aspect, the present invention is directed to a method of raising a tongue of a shoe when worn, the method comprising providing a footwear accessory, the footwear accessory comprising a pad and sleeve that extends from sides of the pad. The pad having a proximal end and a distal end along length of the pad, wherein the pad is wider at the proximal end in comparison to the distal end. The left and right sides of the pad tapers slightly inwards from the proximal end towards the distal end. The top of the pad slopes downwards from the proximal end towards the distal end, such as the height of the pad at the proximal end is larger than the height of the pad at the distal end. The method further comprises wearing the footwear accessory in the foot, such that the pad is positioned over the bridge of the foot and the distal end of the pad is adjacent to fingers of the foot. The method further comprises a step of wearing the shoe such that the pad is pressed against the tongue of the shoe, when worn.

In one aspect, the present invention is directed to a footwear accessory comprising an elongated pad of a substantially rectangular shape. The pad having a proximal end and a distal end along length of the pad. A sleeve that extends from sides of the elongated pad. The sleeve of the pad is configured to be snugly worn in the foot, such that when the foot accessory is worn in the foot, the pad is positioned over the bridge of the foot. In one exemplary embodiment, the pad is made of any cushioning material, such as foam. In another exemplary embodiment, the sleeve is made of any stretchable material.

These and other objects and advantages of the embodiments herein will become readily apparent from the following detailed description taken in conjunction with the accompanying drawings.

BRIEF DESCRIPTION OF THE DRAWINGS

The accompanying figures, which are incorporated herein, form part of the specification and illustrate embodiments of the present invention. Together with the description, the figures further explain the principles of the present invention and to enable a person skilled in the relevant arts to make and use the invention.

DETAILED DESCRIPTION

Figure 1:
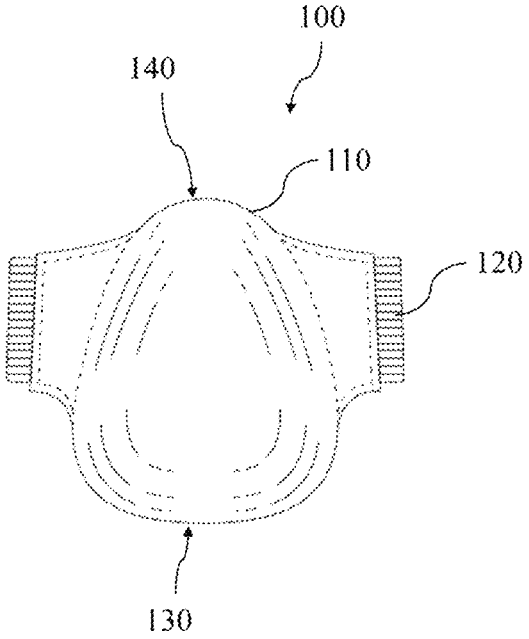
FIG. 1 is a top view of a footwear accessory showing a pad, in accordance with an embodiment of the present invention.

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, a reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The following detailed description includes the best currently contemplated mode or modes of carrying out exemplary embodiments of the invention. The description is not to be taken in a limiting sense but is made merely for the purpose of illustrating the general principles of the invention, since the scope of the invention will be best defined by the allowed claims of any resulting patent.

The present invention is directed to a footwear accessory that prevents discomfort to the foot from wearing the shoe, and enhances the appearance of the shoe, when worn. As shown in FIG. 1, the footwear accessory 100 comprises a pad 110 and a sleeve 120 extending from the left and right sides of the pad 110. FIG. 1 shows the top side of the pad having a proximal end 130 and a distal end 140 along the length of the pad 110. The pad 110 is wider at the proximal end 130 and narrower at the distal end 140. The sides of the pad 110 taper inwards from the proximal end 130 towards the distal end 140. While the pad 110 is shown with round edges, the edges may be prominent. Similarly, the front side of the pad 110 at the distal end 140 is shown curved, it may be straight.

Figure 2:
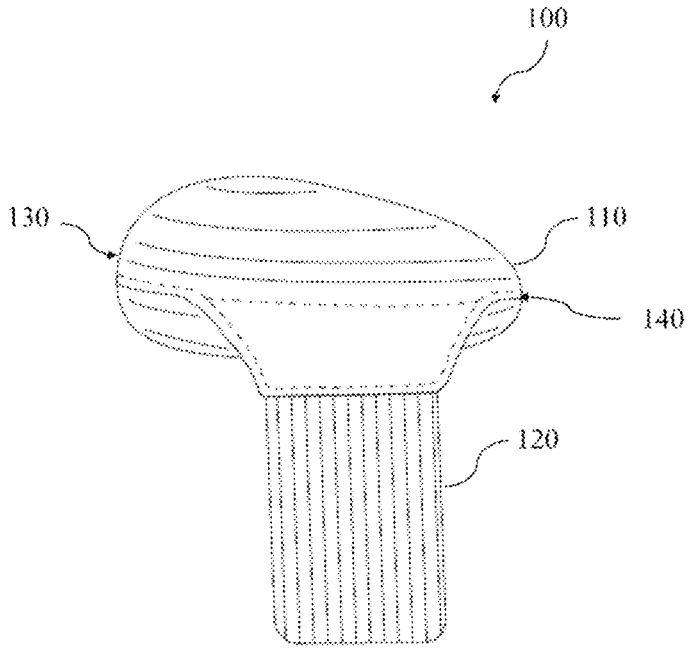
FIG. 2 is a side view of the footwear accessory of FIG. 1, showing the pad and a sleeve, in accordance with an embodiment of the present invention.
Figure 3:
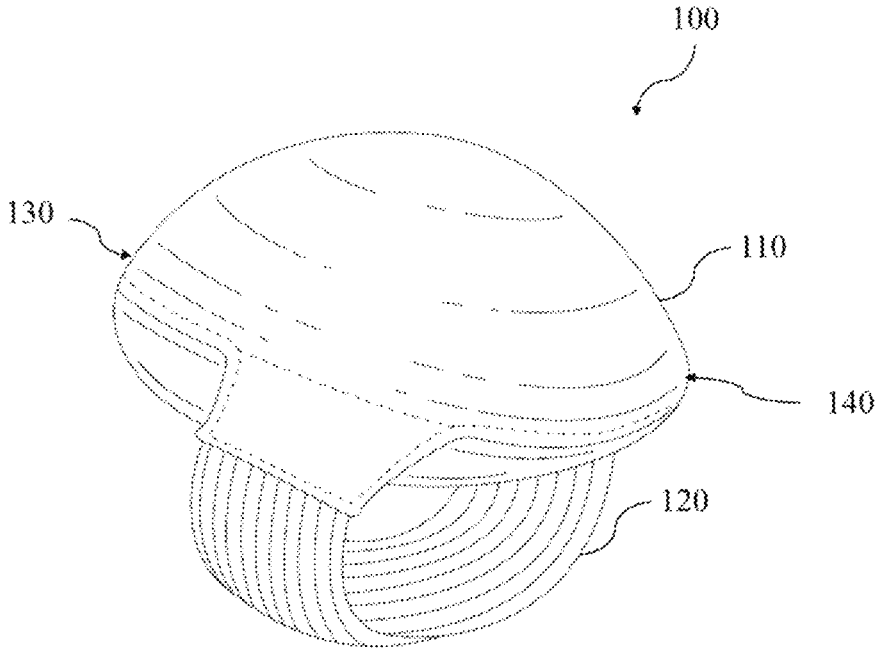
FIG. 3 is a perspective view of the footwear accessory of FIG. 1, in accordance with an embodiment of the present invention.

FIG. 2 shows the side view of the footwear accessory 100. The pad 110 is having a larger height at the proximal end 130 in comparison to the distal end 140. The top surface of the pad 110 slopes downwards from the proximal end 130 towards the distal end 140. Also, the edges of the front side at the distal end 140 and the rear side at the proximal end 130 are shown curved, it may be steep. The sleeve 120 extends from the left and right side of the pad 110. The integration of the sleeve 120 to the pad 110 can be more clearly seen in FIG. 3. The width of the sleeve 120 is shown to be less than the length of the pad 110. However, the width of the sleeve 120 can be varied. The sleeve 120 is configured to be worn snugly in the foot, such that the pad 110 is positioned over the bridge of the foot, while the sleeve 120 wraps around the arch of the foot. To snugly fit around the foot, the sleeve 120 can be made of any stretchable material, such as viscose. Also, the pad 110 can be made of any cushioning and soft material, such as foam.

Figure 4:
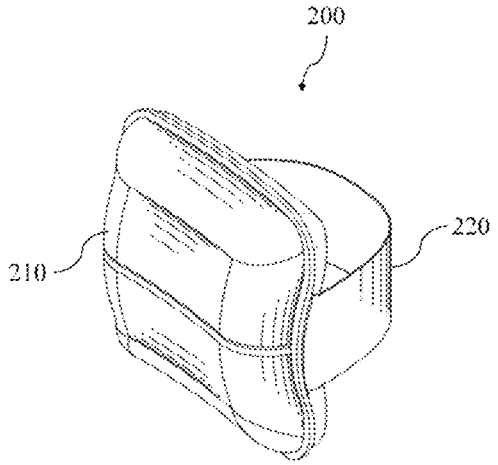
FIG. 4 is a perspective view of the footwear accessory, in accordance with an alternate embodiment of the present invention.
Figure 5:
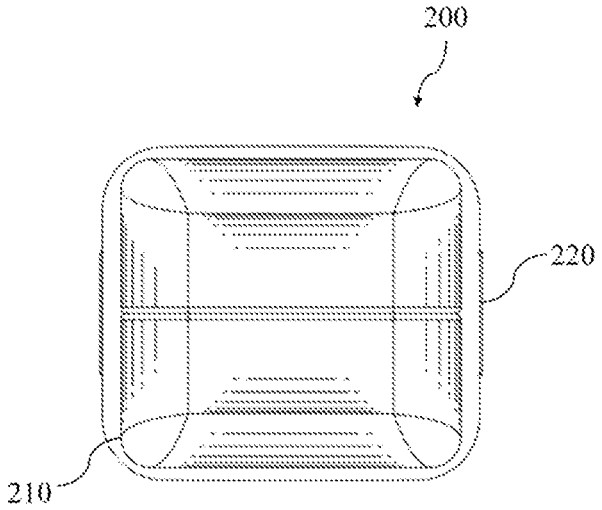
FIG. 5 is a top view of the footwear accessory of FIG. 1.

FIGS. 4 and 5 shows an alternate embodiment of the present invention, which is a footwear accessory 200 having a substantially rectangular shape pad 210 and a sleeve 220 extending from elongated pad 210. The pad 210 is made of any cushioning and soft material, such as a foam. The sleeve 220 is stitched to the pad 210, and a hem is provided along the perimeter of the pad 210.

Figure 6:
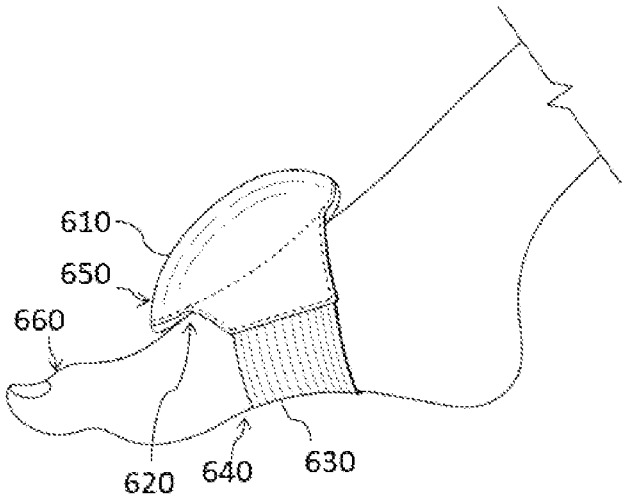
FIG. 6 shows the footwear accessory donned over a foot, in accordance with an embodiment of the present invention.

FIG. 6 shows the footwear accessory donned over a foot. The footwear accessory has a pad 610 positioned over a bridge 620 of the foot. A sleeve 630 around an arch 640 of the foot, wherein the distal end 650 of the pad 610 is adjacent a toe 660 of the foot.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A method of enhancing appearance and comfort of a footwear when worn, the method comprising:

providing a footwear accessory, the footwear accessory consisting of:

a pad having a left side, right side, a proximal end, and a distal end, the proximal end and the distal end are along a length of the pad, a sleeve that extends from the left side and the right side of the pad, the sleeve configured to be snugly donned over a foot, wherein the sleeve configured to fit around an arch of the foot such that the pad is positioned over a bridge of the foot, wherein the pad tapers inwards from the proximal end towards the distal end such that the pad is wider at the proximal end and narrower at the distal end, the pad slopes downwards from the proximal end towards the distal end such that a height of the pad at the proximal end is larger than a height of the pad at the distal end; and donning the sleeve over the foot, such that the pad is positioned over a bridge of the foot and the distal end of the pad is adjacent to a toe of the foot.

2. The method of claim 1, wherein the method further comprises:

wearing the footwear such that the pad is pressed against a tongue of the footwear.

3. The method of claim 1, wherein the pad is substantially rectangular shape.

4. The method of claim 1, wherein the pad is made of foam and the sleeve is made of a stretchable material.

* * * * *